US007722038B1

(12) United States Patent
Moore et al.

(10) Patent No.: US 7,722,038 B1
(45) Date of Patent: May 25, 2010

(54) RETRACTABLE IMAGE CAMERA MECHANISM FOR A DOCUMENT PROCESSING SYSTEM

(75) Inventors: Michael J. Moore, Beverly Hills, MI (US); Sammy C. Hutson, Novi, MI (US); John Gudenburr, Canton, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 1117 days.

(21) Appl. No.: 11/093,359

(22) Filed: Mar. 30, 2005

(51) Int. Cl.
*B65H 5/02* (2006.01)

(52) U.S. Cl. ..... 271/273; 399/124; 358/498

(58) Field of Classification Search ..... 271/273, 271/274; 400/637.1; 235/475, 483, 484, 235/485; 399/124, 118; 358/496, 498
See application file for complete search history.

(56) References Cited

U.S. PATENT DOCUMENTS

| | | | | |
|---|---|---|---|---|
| 4,630,815 | A | 12/1986 | Petersen et al. | |
| 5,419,546 | A | 5/1995 | Chen et al. | |
| 5,431,389 | A * | 7/1995 | Wensink et al. | 271/273 |
| 5,437,375 | A | 8/1995 | Chen et al. | |
| 5,439,506 | A | 8/1995 | Chen et al. | |
| 5,509,648 | A | 4/1996 | Chen et al. | |
| 5,671,919 | A | 9/1997 | Chen et al. | |
| 5,848,784 | A | 12/1998 | Tranquilla | |
| 5,908,191 | A | 6/1999 | Chen et al. | |
| 6,199,854 | B1 | 3/2001 | Tranquilla et al. | |
| 2003/0115071 | A1 * | 6/2003 | Reid | 705/1 |
| 2003/0206318 | A1 * | 11/2003 | Breslawski et al. | 358/498 |

* cited by examiner

*Primary Examiner*—Patrick Mackey
*Assistant Examiner*—Jeremy Severson
(74) *Attorney, Agent, or Firm*—Honigman Miller Schwartz and Cohn LLP

(57) ABSTRACT

A document processing system includes a feeder stage, a transport stage, and a retractable mechanism cooperating with a portion of the document track. An assertable member is arranged with respect to the document track such that assertion of the member causes retraction of the opposed track walls in the cooperating portion of the document track by retracting a first base member from a second base member. An imaging assembly is composed of an imaging device and an image glass. The image glass is positioned as one side of the document track at the retractable mechanism. In the retracted state, the imaging assembly is retracted to provide access to the imaging device and the document track.

12 Claims, 10 Drawing Sheets

RETRACTABLE IMAGE CAMERA MECHANISM FOR A DOCUMENT PROCESSING SYSTEM

BACKGROUND OF THE INVENTION

1. Field of the Invention

The invention relates to document handling equipment including systems for feeding and transporting documents.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, through a track past other processing devices such as readers, printers, and sorters that perform operations on the documents. The feeder is typically a feed wheel, but may take other forms. Further, the components in the transporting portion of the system may take a variety of forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

Image cameras in document handling equipment, like but not limited to, check sorters and postal letter sorters typically have the tallest document guide walls or trackwalls in general proximity of these devices. The tall guide walls are necessary for proper presentment of a document to an image camera (or contact image sensor). The typical trackwall width ranges from about 0.040 to 0.125 inches. The typical trackwall height by the image camera is in the 5 to 6 inch range. Typical documents traveling down the track past the image cameras range up to from about 2.375 to 5.5 inches in height. So most documents are hidden in the track from operator view by image cameras.

Document handling equipment requires periodic removal of documents along the document path. The narrow, deep track around image cameras makes it extremely difficult to remove document jams. The removal of documents is necessary due to jams caused by ripped or torn edges, staples, mutilated documents, rubber bands, folded edges and so on.

Document handling equipment also requires accessibility to the track for cleaning, adjustment and maintenance purposes. This could include debris removal and cleaning of the image glass/track interface. Build up of debris like paper dust and ink from documents on image glass degrades the image quality. The image quality is vital in the banking industry, especially since the implementation of "Check Clearing for the 21$^{st}$ Century Act" (Check 21). Accessibility is also necessary for camera calibration. Under Check 21, image replacement documents (IRDs) and substitute checks are generated based in part on images from the image camera.

The current art typically has a document track with drive rollers and pinch rollers positioned along the document path to propel the document down the track. The document sidewalls are usually rigid and non-movable. When the document stops, jams or if devices, such as image cameras, positioned within the track need maintenance, this creates a difficult recovery or maintenance environment due to the lack of accessibility, and creates significant downtime for operations. The non-accessible track configurations reduce throughput of documents due to the difficulty and time spent in document removal and maintenance.

The typical document track is narrow and deep, typically with only the top portion of a document visible, or with no document visibility at all. Document removal in the current state of the art includes levers and knobs to retract pinch rollers for assisting document removal. This feature helps, but does not address hard document jams, maintenance, image camera glass cleaning and debris removal. The same is true for sidewalls that pivot. Document track sidewalls that pivot are helpful, but do not give complete accessibility to the document track and devices. Tools such as thin wands are needed for cleaning and debris removal in the current state of the art, and visibility into the document track is difficult, which makes document clearing, image camera cleaning, and adjustments and calibrations difficult and costly. Other solutions include removable track walls, which do give good access to the document track, but removal of track walls takes time and tools are required for removal. Removable track walls, especially those with electronic devices embedded into the walls (like sensors) are at risk for damage during multiple removals.

Covers and lids are necessary for protection of machine operators and are required by regulatory agencies, and are usually necessary for acoustical requirements and sometimes for electromagnetic interference protection. These covers may have to be opened to gain access for document removal or for access to levers, cams, pivots or any other devices necessary to remove documents or to perform operator maintenance. Cover and lid removal are time consuming and thus impact productive operations.

Additional background information may be found in U.S. Pat. No. 4,630,815.

For the foregoing reasons, there is a need for an improved approach to image camera maintenance in a document processing system.

SUMMARY OF THE INVENTION

It is an object of the invention to provide an improved retractable image camera mechanism for providing access to the image camera in a document processing system.

In carrying out the invention, a retractable image camera mechanism is provided. The mechanism provides the capability for the machine operator to open the track by depressing a push button, which in turn activates a mechanism that retracts the image camera and associated apparatus. That is, the invention comprehends an approach where assertion of a push button or other suitable assertable member activates the mechanism that retracts the image camera.

The track opening distance is set so an operator can easily remove document jams, stopped documents, staples and paper debris, and perform routine maintenance or device adjustment. The invention further comprehends an approach where the operator has a direct line of sight to the track bottom when the track is in the retracted state. In this way, the machine operator can perform maintenance on the system, and has easy access to image camera glass for fast and easy cleaning.

In another aspect of a preferred approach, the cover does not have to be removed to operate the retraction mechanism and perform system maintenance. To return the mechanism to the closed state from the open/retracted state, the machine operator closes the retractable image camera mechanism by pushing the mechanism forward until a precision locating device locks the mechanism in the closed position. In another aspect of a preferred approach, the entire opening and closing cycle is quick and easy and is a positive improvement on efficient operations and document throughput. This mechanism directly reduces machine downtime. Another major benefit is that the image camera may illuminate the track when the camera is retracted, providing enhanced visibility to the track bottom.

Further, in carrying out the invention, various combinations of the comprehended features may be employed in various arrangements to provide a retractable image camera mechanism. The mechanism retracts an image camera in response to assertion of a push button or equivalent. There are advantages to using a retraction approach as opposed to levers and knobs that retract pinch rollers, pivotable sidewalls, thin cleaning wands, or removable track walls. The retraction approach contemplated by the invention provides full access to the image camera as opposed to the rather limited access or overly complicated procedures provided by other approaches.

In an alternative approach, a fully-automatic retractable image camera mechanism may be provided. In this alternative, suitable sensors and/or system logic detects a problem and causes actuation of the image camera retraction mechanism. The retraction mechanism may be driven by, for example, a servomotor. After an operator addresses the situation, the mechanism may be pushed forward until the precision locating device locks the mechanism in the closed position. As well, the closing process may also be partially or fully automated.

Advantages associated with various embodiments of the invention are numerous. For example, preferred embodiments include a retractable image camera that provides unrestricted access to the document track, superior access to image glass for cleaning, illuminated track in the open position for enhanced visibility, improved access for camera calibration, a semi- or fully-automatic retraction mechanism, a precision locating device that positions and re-positions the camera, a suitable document drive that is compatible with the retraction system, and/or covers that do not have to be removed for camera and track accessibility. In an optimum configuration, the camera retracts a minimum of 1.750 inches to allow for an operator's hand to access the document track. It is appreciated that suitable modifications may be made to accommodate various image capture devices.

DETAILED DESCRIPTION OF THE PREFERRED EMBODIMENTS

Figure 1:
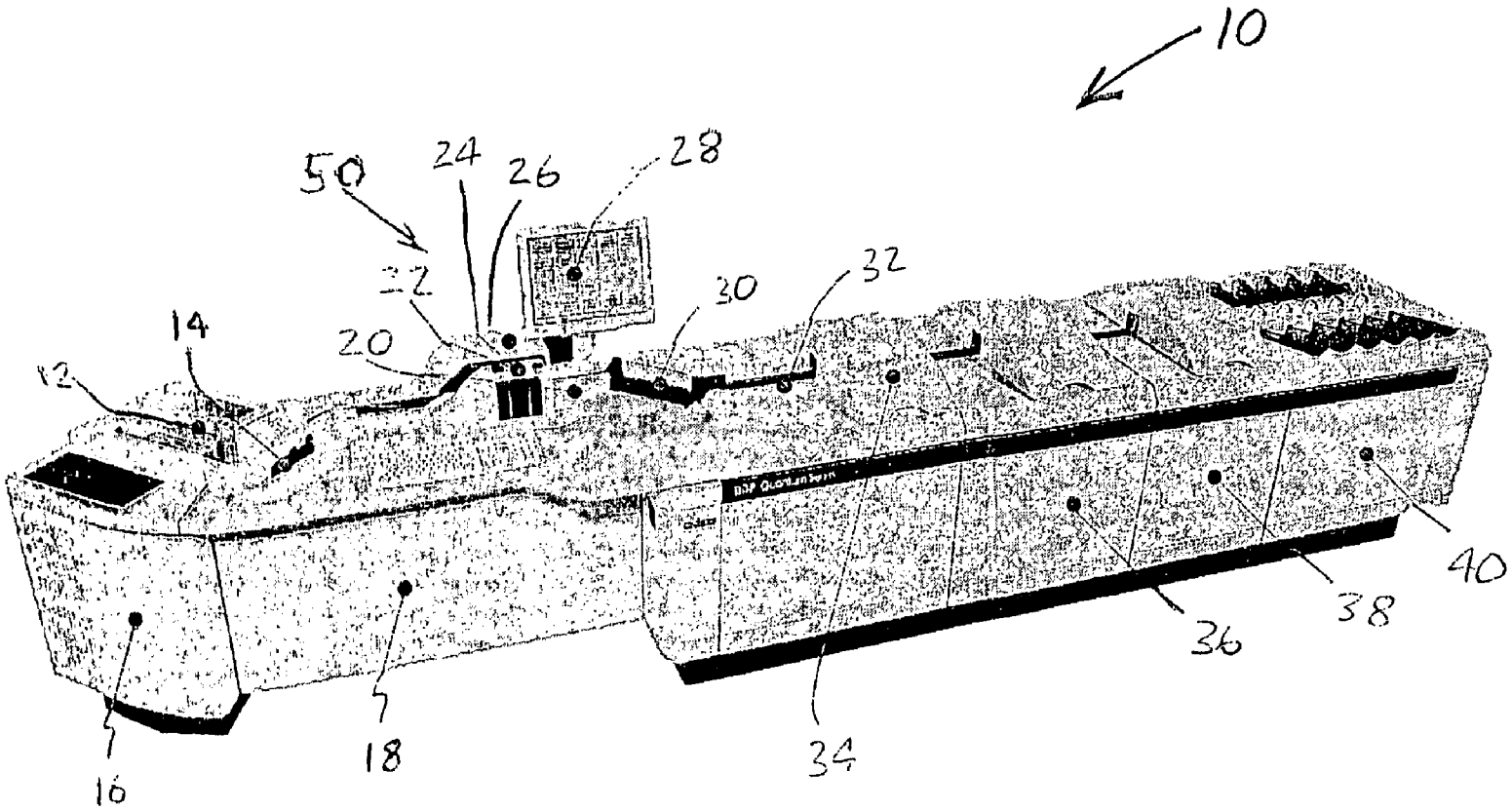
FIG. 1 illustrates a document processing system made in accordance with a preferred embodiment of the invention.

FIG. 1 illustrates a document processing system for feeding and transporting documents at 10. System 10 includes a primary feeder 12 and a secondary feeder 14. Cabinet 16 houses a computer running software for system 10. System 10 further includes removable kneewell panel 18. The feeders act to separate and feed documents singly, in order, from a stack. The remainder of the system is the transporting portion of the system, which includes a number of roller pairs and/or belts to convey the documents, one at a time, through a track past other processing devices that perform operations on the documents.

As shown in FIG. 1, a number of processing devices are located in the transporting portion of the system 10. Magnetic ink character recognition (MICR) reader 20 and optical character recognition (OCR) reader 22 are located in the document track following secondary feeder 14. As well, upstream imaging devices 24 and 26 image each passing document. The operator display is indicated at 28.

With continuing reference to FIG. 1, system 10 further includes a post-read view station 30, and a low-speed document encoder 32. As well, a multi-jet endorser (MJE) is located at 34. Further down the document track, an amount-only or full-field high-speed encoder 36 and downstream imager 38 process the passing documents. Finally, a 12-pocket stacker module 40 is provided for the actual sorting of the documents into pockets. The drawings illustrate the preferred system, which is depicted as an NDP Quantum Series transport available from Unisys.

FIGS. 2-7 and 8 illustrate document handling mechanisms for use in a document processing system. In these Figures, the imaging assembly is removed, and the associated following description explains the general operation of the document handling mechanisms.

Figure 9:
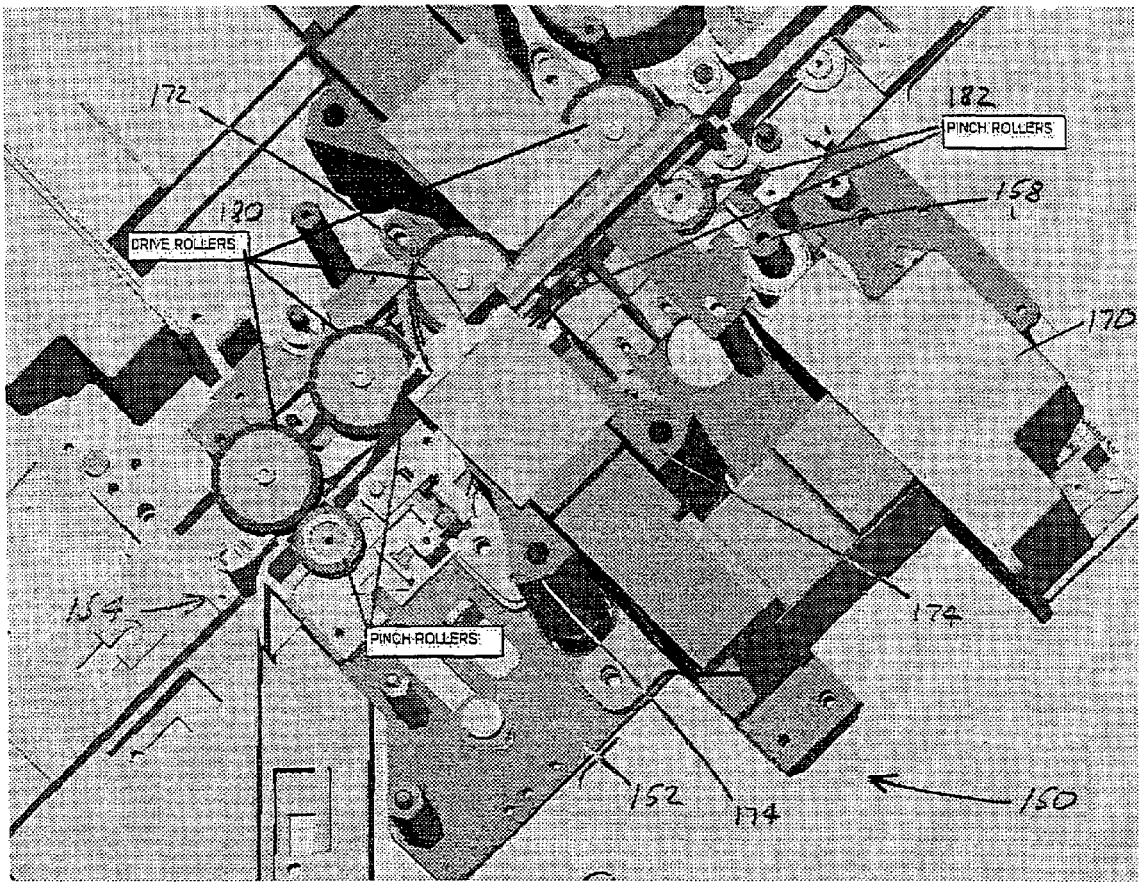
FIG. 9 illustrates a retractable image camera implementation in accordance with the invention, showing the semi-automatic document handling mechanism with both covers and the back track wall removed to expose the document drive and image camera in the closed position.
Figure 10:
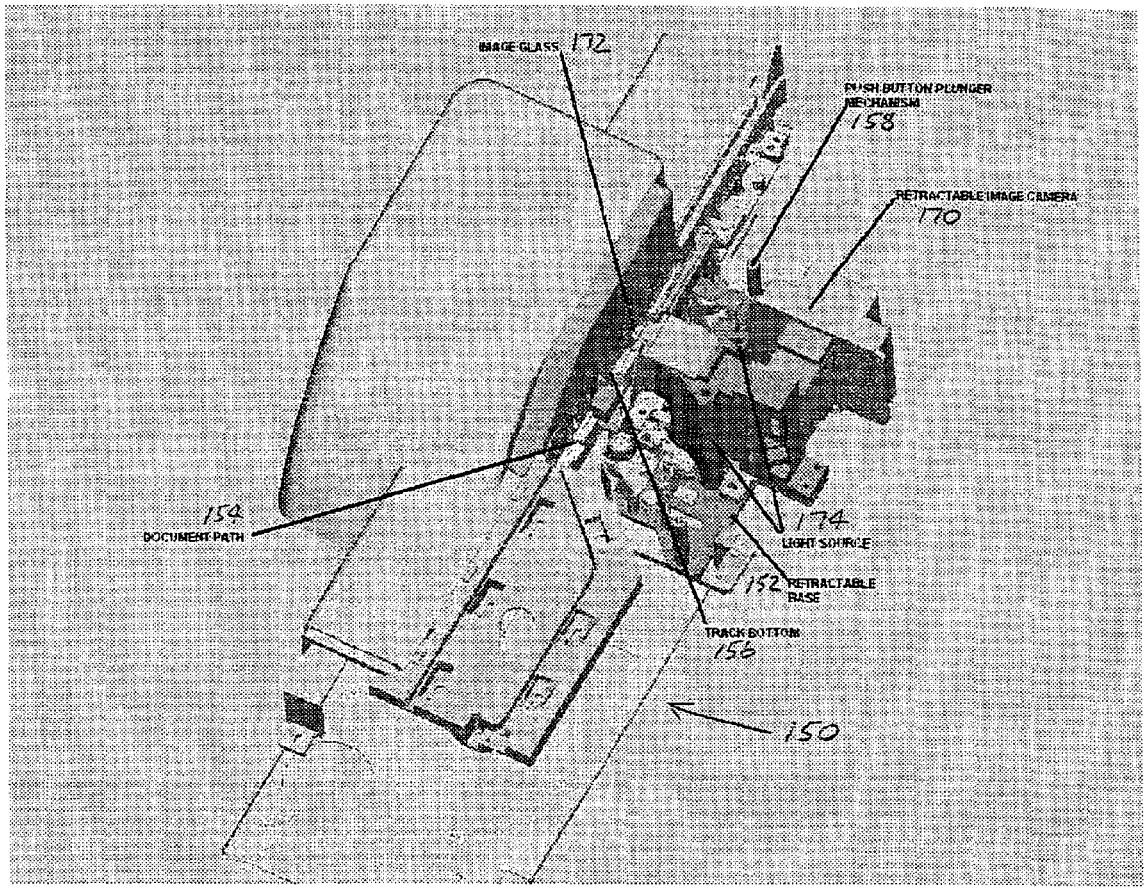
FIG. 10 illustrates a retractable image camera implementation in accordance with the invention, showing the mechanism in the open position and with the front cover removed.

In FIGS. 9-10, an exemplary document handling mechanism, in accordance with the invention, is outfitted with an imaging assembly to illustrate the preferred embodiment of the invention. The invention involves a retractable imaging assembly in a document handling mechanism.

Figure 2:
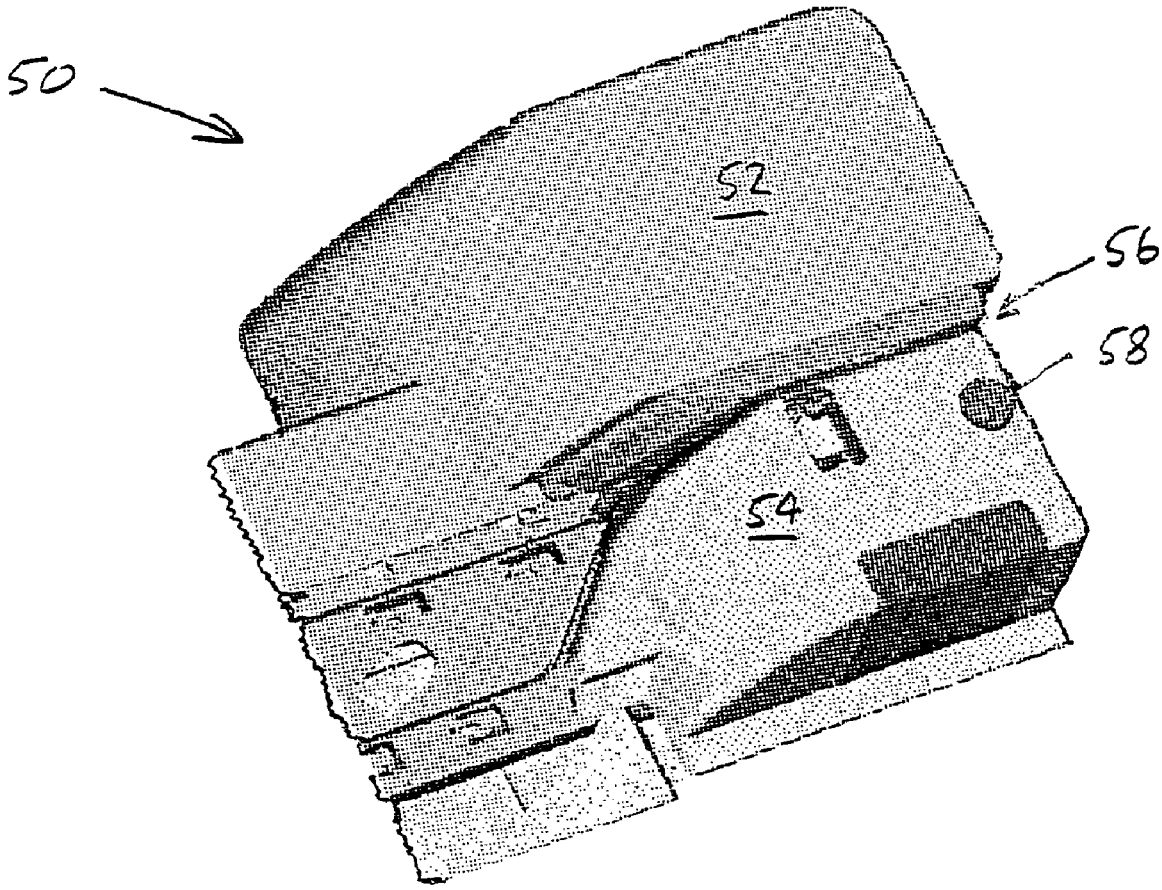
FIG. 2 is an enlarged view of a semi-automatic document handling mechanism.
Figure 3:
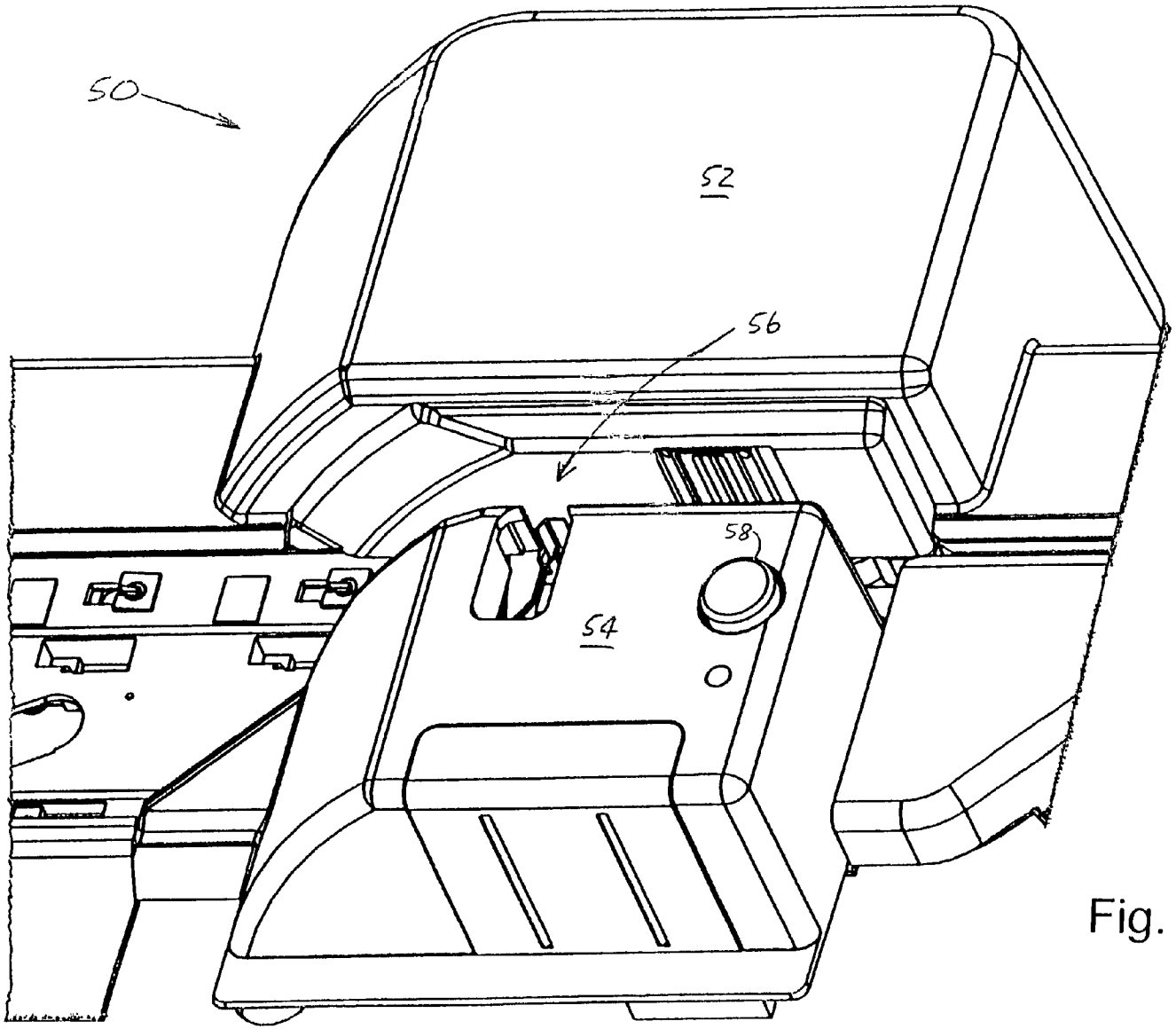
FIG. 3 shows the semi-automatic document handling mechanism in the open position.
Figure 4:
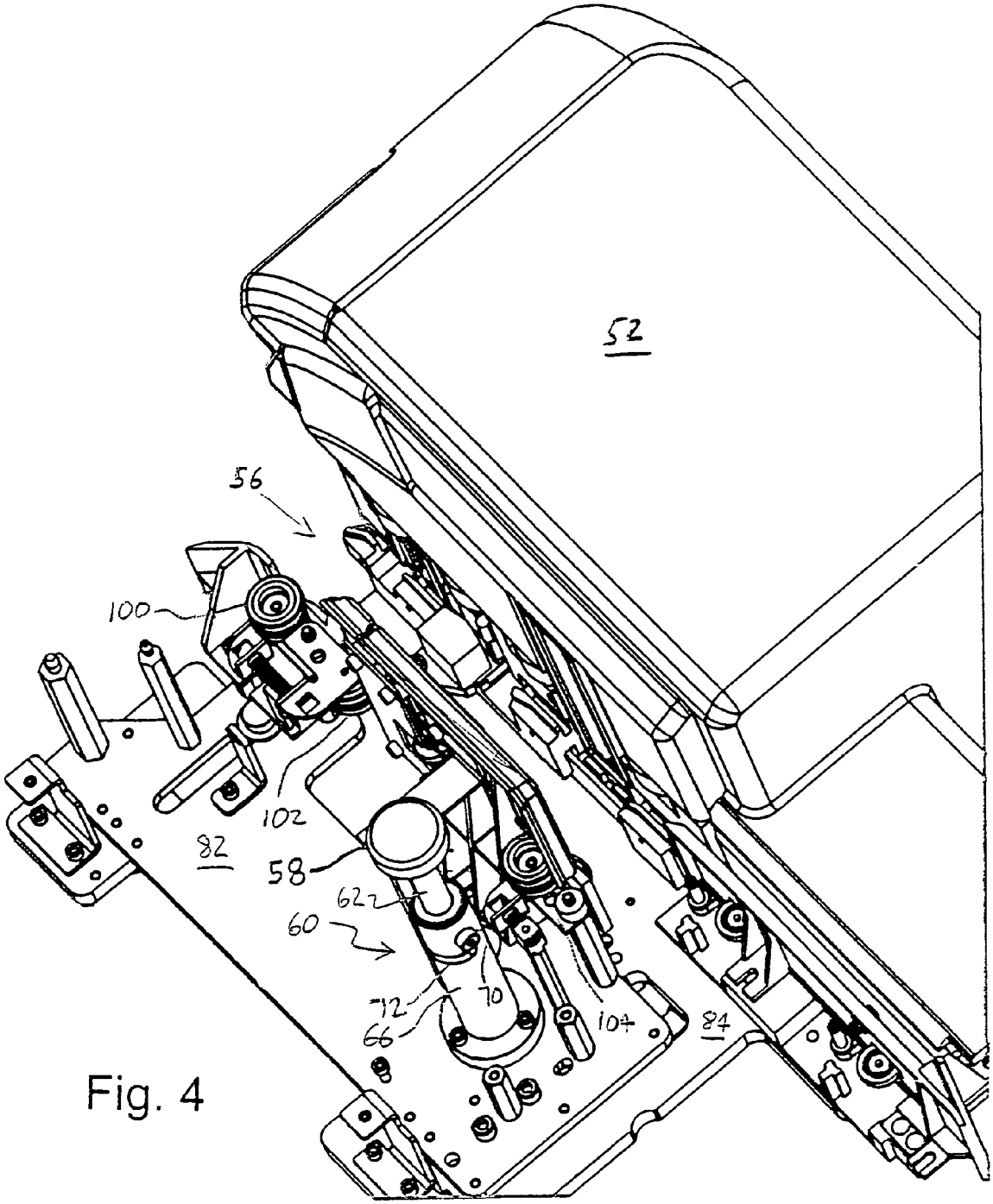
FIG. 4 shows the semi-automatic document handling mechanism in the open position with the cover removed, showing clear visual and physical access to the track.
Figure 5:
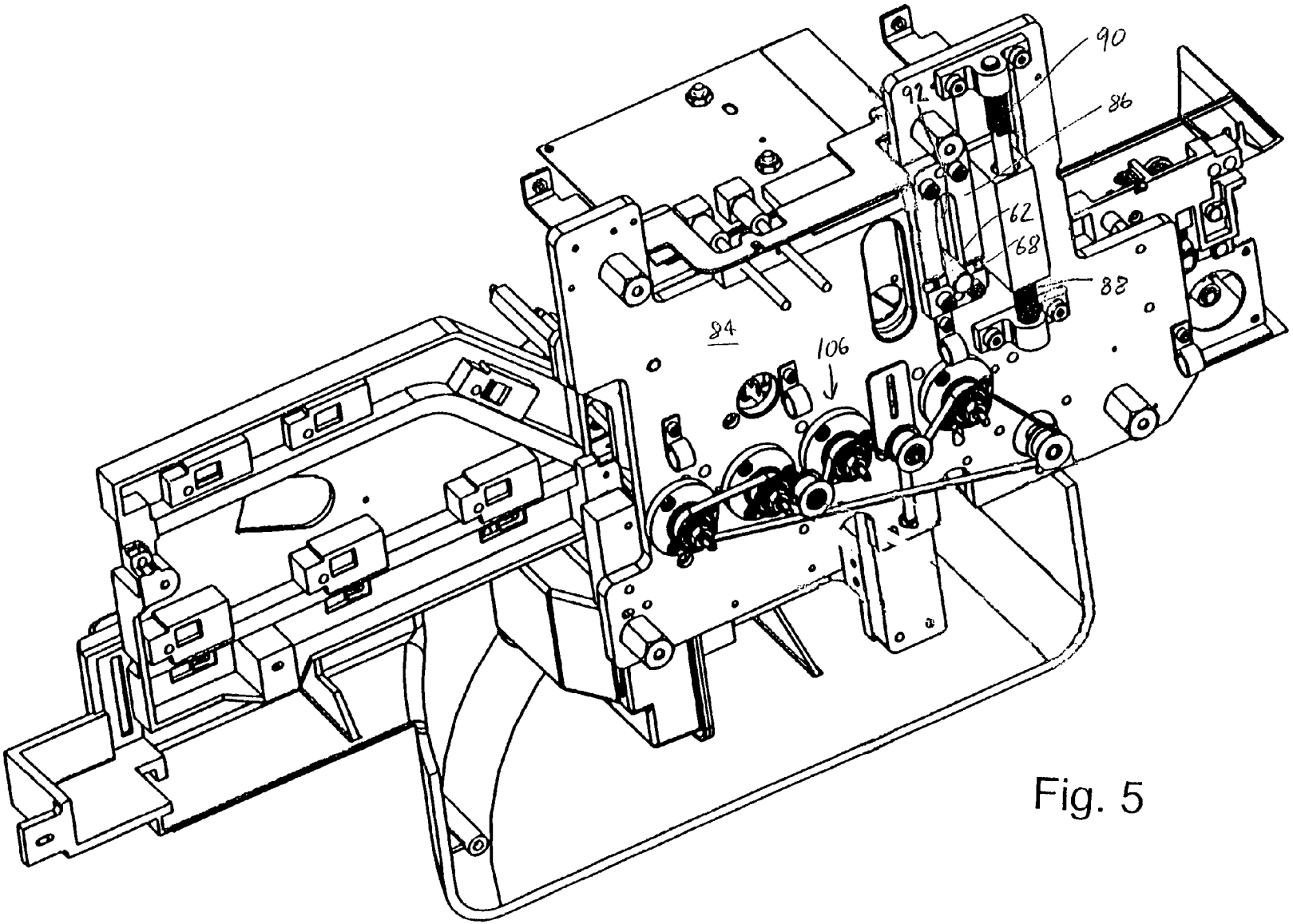
FIG. 5 shows the semi-automatic document handling mechanism from the bottom.
Figure 6:
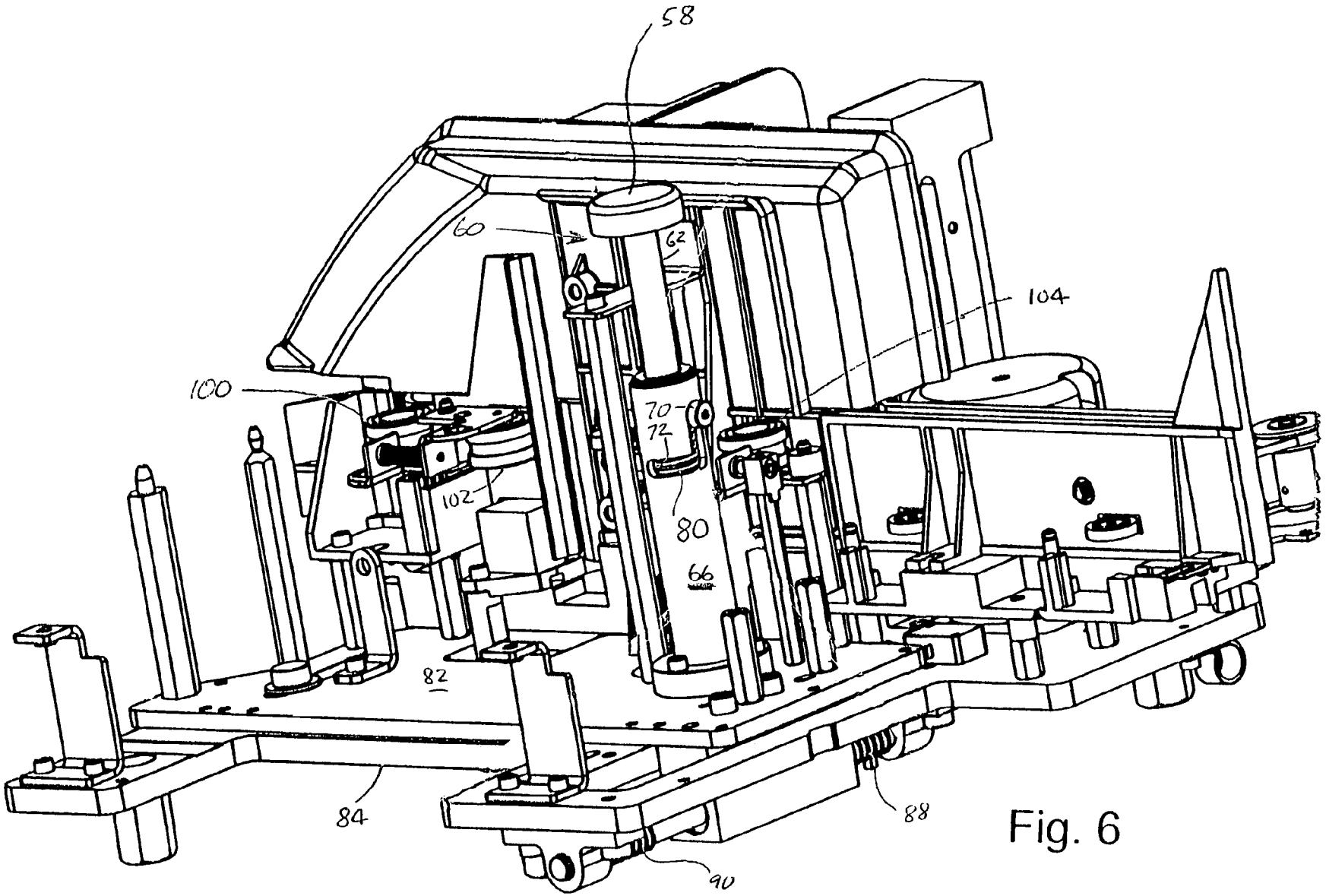
FIG. 6 is another view of the semi-automatic document handling mechanism; in this view the precision locating mechanism is more clearly visible.
Figure 7:
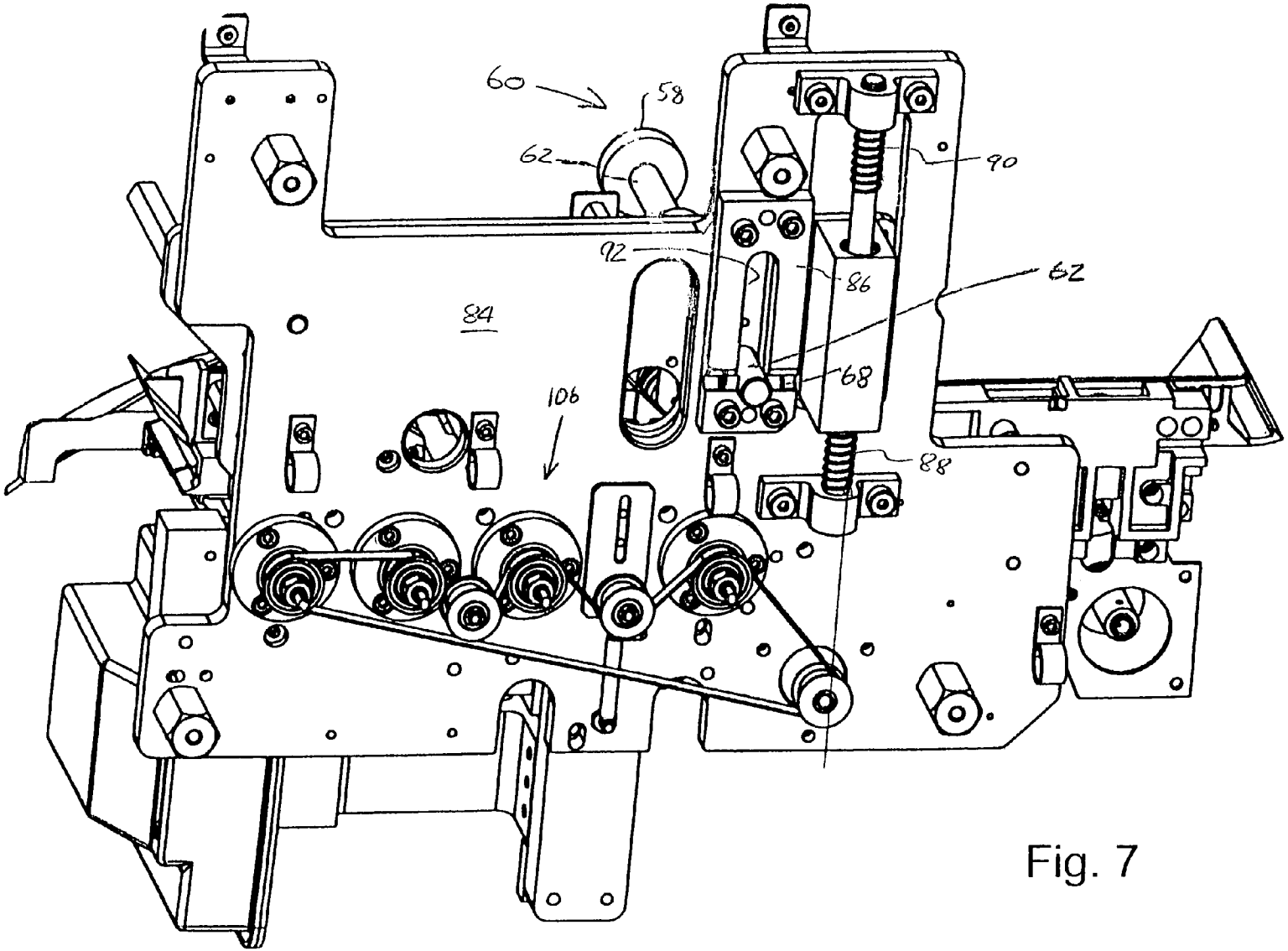
FIG. 7 is another view of the semi-automatic document handling mechanism from the bottom.

With reference to FIG. 2, the semi-automatic document handling mechanism is indicated at 50. Each half of the mechanism has a cover 52,54, and the track area is indicated at 56. Push button 58 is asserted to cause the mechanism to retract, opening up the track area for operator access. FIG. 3 shows the semi-automatic document handling mechanism in the open position.

FIGS. 4-7 illustrates various components of the semi-automatic document handling mechanism in the preferred construction in greater detail. With continuing reference to these figures, the retractable document handling mechanism 50 provides access to the track area 56 in the document processing system 10. The mechanism provides the capability for the machine operator to open the track area 56 by depressing the push button 58. Pressing push button 58, in turn, activates a mechanism that retracts the rigid document track walls. The track open distance is set so that an operator can easily remove document jams, remove stopped documents, remove staples and paper debris, and perform routine maintenance or device adjustment.

Advantageously, the operator has a direct line of sight to the track bottom. Advantageously, covers 52 and 54 do not have to be removed. The machine operator closes the semi-automatic retractable document handling mechanism 50 by pushing cover 54 until the precision locating device locks the mechanism in the closed position. The entire open and closing cycle is quick and easy and is a positive improvement on efficient operations and document throughput. This mechanism directly reduces machine downtime.

In more detail, by depressing button 58, repositioning device 60 is actuated. Button 58 pushes a connecting rod 62 that is located in a housing 66 and is guided by two precision bushings. At the opposite end of connecting rod 62 is a precision pin 68 pressed into connecting rod 62 at a 90° angle. Connecting rod 62 also has a tapped hole with a locating counterbore that receives a shoulder screw 70 that passes through a special slot 72 on housing 66.

This feature provides anti-rotation in use, yet can still be rotated 90° for assembly purposes in the fully depressed mode of assembly 60. Connecting rod 62 has compression spring 80 acting on it to urge button 58 to the deasserted or upward position. The entire repositioning device 60 rests and is positioned on a moving base 82. Pin 68 on the end of connecting rod 62 nests in a groove in slot 92 on a wear plate 86 mounted on fixed base 84 (in the closed position).

This arrangement gives the precision location needed to properly locate the track walls for operation. Depression of connecting rod 62 by pushing button 58 causes pin 68 to clear the groove in slot 92 in wear plate 86, and allows for the moving base 82 to retract by means of an assist spring 88. A counter spring 90 acts as a dampener and absorbs any potential mechanical shock during the semi-automatic opening of the retraction mechanism. Wear plate 86 has slot 92 through the center of wear plate 86 to allow for travel of moving base 82. The wear plate 86 is preferably constructed of hardened tool steel to provide long life and also has a surface finish that provides a low coefficient of friction, as the locating pin 68 slides back and forth on the surface.

The operator closes the re-positioning device by simply pushing the retracted assembly forward, and the pin 68 snaps into the groove, giving the repeatable location necessary for proper track gaps, sensor alignment and for alignment of other electronic devices including, but not limited to, magnetic read heads and pressure devices, drive and pinch rollers, optical cameras and the like. Advantageously, cover removal is not required to open the apparatus, access the track, and close the apparatus back to the precision location.

The semi-automatic re-positioning device for the document handling apparatus 10 can be opened and closed in seconds and gives true and unrestrictive access to the document track area 56. The device allows easy document removal by the operator and allows the operator to perform maintenance previously done by field engineers. The device reduces machine downtime and enables increased document throughput.

In addition to the advantages described above, it is appreciated that the apparatus retracts multiple pinch rollers upon the machine operator pressing button 58. When button 58 is pushed, multiple pinch rollers retract via the spring-assisted mechanism. As shown, pinch rollers 100,102,104 retract to a position that provides physically unrestricted access to the track area 56 for document removal, cleaning and maintenance, and device adjustment.

An operator can easily put his hand into the track and do whatever tasks are necessary in a very short time frame. The operator can see directly into the track and would have no problem clearing documents, cleaning out debris or performing other maintenance procedures.

To close the apparatus, the machine operator pushes cover 54 forward and the retracted assembly snaps back into a repeatable precise closed position. The operation of the apparatus is ergonomically intuitive for any machine operator to use. The apparatus not only enables increased document throughput due to less machine downtime but allows for maintenance procedures to be performed by the operators instead of field engineers.

Figure 8:
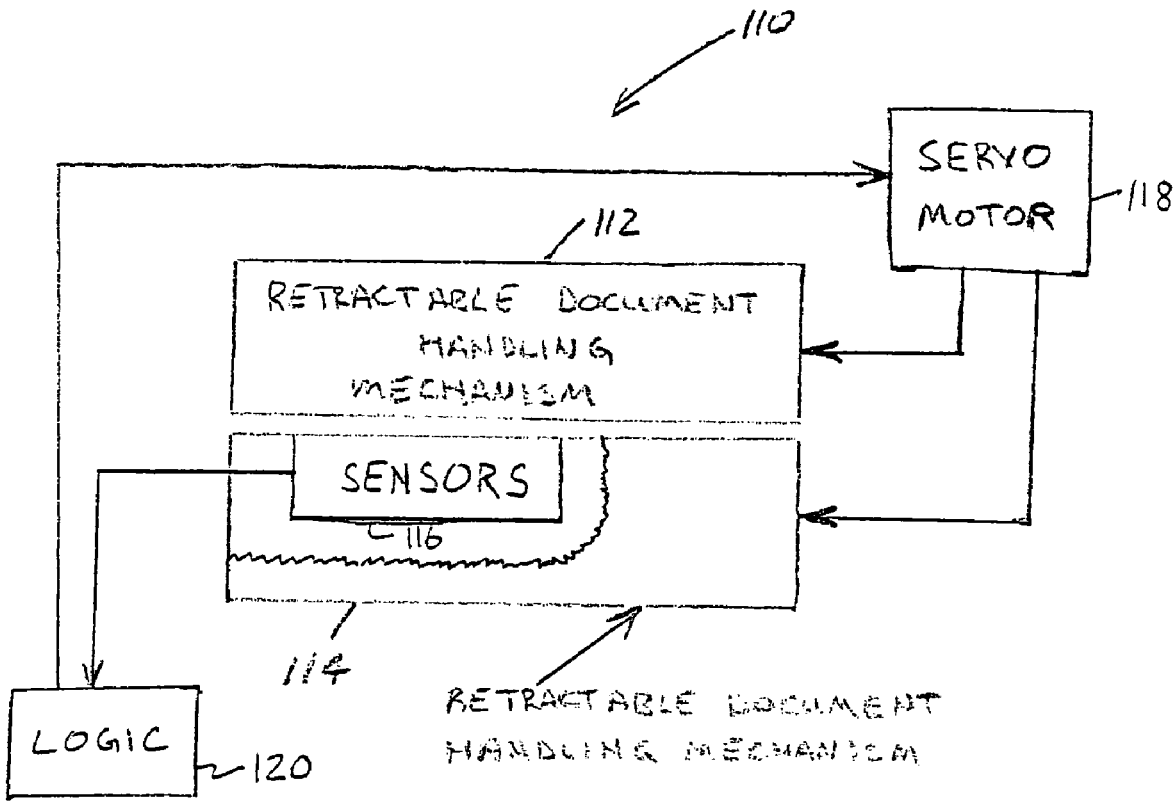
FIG. 8 illustrates a fully-automatic document handling mechanism that is used in alternative embodiments of the invention.

FIG. 8 illustrates a fully-automatic document handling mechanism 110 that may be used in alternative constructions. As with the other described configuration, the mechanism includes first and second halves 112 and 114 where one part of the handling mechanism forms the fixed base while the other part of the handling mechanism forms the movable base. Sensors 116 and system logic 120 are configured to detect a problem occurring in the cooperating portion of the document track. Detection of a problem causes actuation of the retraction mechanism, which is shown being driven by servomotor 118. After an operator addresses the problem situation, the mechanism may be manually urged back together until the precision locating device locks the mechanism into closed position. In addition, the closing process may also be partially or fully automated.

FIGS. 9 and 10 illustrate a retractable image camera implementation in accordance with a preferred embodiment of the invention. The retractable mechanism is generally indicated at 150. The document path is indicated at 154, and retractable mechanism 150 cooperates with a portion of the document track. Each side of the document track is carried by a separate base member of mechanism 150. As shown, movable base member 152 carries one side of the document track, while the other side is carried by a fixed base member. In FIG. 9, the overall document handling mechanism is shown with both covers and the back track wall removed to expose the document drive and image camera in the closed position. In FIG. 10, the mechanism is shown in the open position and with the front cover only removed. In FIG. 10, the track bottom is visible at 156. Pushbutton plunger mechanism 158 is the assertable member that causes retraction of the opposing track walls when asserted.

In accordance with the invention, an imaging assembly composed of an imaging device and an image glass positioned as one side of the document track at the retractable mechanism is provided. In the preferred implementation which is illustrated, retractable camera 170 and image glass 172 are carried on retractable base 152 of retractable mechanism 150. Light source 174 operates to illuminate the surrounding track area when the track is open. Preferably, the imaging device is an image camera. It is appreciated that a contact imaging device could be utilized in the alternative. In the retracted position, retraction of the imaging assembly is sufficient to provide a direct line-of-sight to a bottom of the track.

The proximity of the retractable image camera 170 and image glass 172 to other components is best shown in FIG. 9, where drive rollers are indicated at 180 and pinch rollers are indicated at 182. It is appreciated that all of the preferred implementation is shown in FIGS. 9 and 10, the invention comprehends that various different implementations are possible and the retractable mechanisms described herein are exemplary.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A document processing system for feeding and transporting documents, the system comprising:

a feeder stage including a hopper assembly and a feeder wherein the feeder acts to feed documents singly, in order, form a stack of documents in the hopper assembly;

a transport stage downstream of the feeder stage for receiving the fed documents, the transport stage including a document track composed of a pair of opposing rigid track walls wherein, during transportation, the documents are moved along the document track in a series to allow operation to be performed on the documents;

a retractable mechanism cooperating with a portion of the document track and including a first base member that carries the other side of the document track;

an imaging assembly composed of an imaging device and an image glass positioned on one side of the document track at the retractable mechanism; and an assertable member arranged such that assertion of the member causes retraction of the opposing walls in the cooperative portion of the document track by retracting the mechanism and thereby retracting the imaging assembly;

wherein the retractable mechanism includes a mechanical spring and lock arrangement wherein, in response to the assertion of the assertable member, the arrangement unlocks and the spring causes the retracting of the first base member to cause the relative retracting of the imaging assembly;

wherein the imaging assembly is coupled to the retractable mechanism to facilitate movement of the imaging assembly.

2. The system of claim 1 wherein the imaging system is an image camera.

3. The system of claim 1 wherein the refraction is sufficient to provide a direct line of sight to a bottom of the track when the imaging assembly is retracted.

4. The system of claim 1 further comprising:

a precision locating device affixed to the first base; and a mating component on the second base such that the mating component interlocks with the precision locating device when the track is in the closed state to precisely locate the imaging system.

5. The system of claim 1 further comprising:

at least one pinch roller affixed to the first base, wherein the at least one pinch roller engages the documents when the retractable mechanism is in the closed state, and wherein the at least one pinch roller is retracted to provide access to the document track when the retractable mechanism is in the retracted state.

6. The system of claim 1 wherein the imaging assembly further comprises:

an illumination device for illuminating the document track when the retractable mechanism is in the retracted state and the imaging assembly is retracted.

7. A document processing system for feeding and transporting documents, the system comprising:

a feeder stage including a hopper assembly and a feeder wherein the feeder acts to feed documents singly, in order, form a stack of documents in the hopper assembly;

a transport stage downstream of the feeder stage for receiving the fed documents, the transport stage including a document track composed of a pair of opposing rigid track walls wherein, during transportation, the documents are moved along the document track in a series to allow operation to be performed on the documents;

a retractable mechanism cooperating with a portion of the document track and including a first base member that carries the other side of the document track;

an imaging assembly composed of an imaging device and an image glass positioned on one side of the document track at the retractable mechanism; and an assertable member arranged such that assertion of the member causes retraction of the opposing walls in the cooperative portion of the document track by retracting the mechanism and thereby retracting the imaging assembly;

wherein the retractable mechanism includes a sensor and servomotor arrangement wherein, in response to the sensor detecting a fault condition, the servomotor causes the retracting of the first base member to cause the relative retracting of the imaging assembly;

wherein the imaging assembly is coupled to the retractable mechanism to facilitate movement of the imaging assembly.

8. The system of claim 7 wherein the imaging system is an image camera.

9. The system of claim 7 wherein the retraction is sufficient to provide a direct line of sight to a bottom of the track when the imaging assembly is retracted.

10. The system of claim 7 further comprising:

a precision locating device affixed to the first base; and a mating component on the second base such that the mating component interlocks with the precision locating device when the track is in the closed state to precisely locate the imaging system.

11. The system of claim 7 further comprising:

at least one pinch roller affixed to the first base, wherein the at least one pinch roller engages the documents when the retractable mechanism is in the closed state, and wherein the at least one pinch roller is retracted to provide access to the document track when the retractable mechanism is in the retracted state.

12. The system of claim 7 wherein the imaging assembly further comprises:

an illumination device for illuminating the document track when the retractable mechanism is in the retracted state and the imaging assembly is retracted.

* * * * *